US005466565A

United States Patent [19]

Shigemori et al.

[11] Patent Number: 5,466,565

[45] Date of Patent: Nov. 14, 1995

[54] COLOR DEVELOPMENT COMPOSITION AND PROCESS

[75] Inventors: Nobuki Shigemori; Hisao Kamo, both of Matsudo, Japan

[73] Assignee: Chugai Phote Chemical Co., Ltd., Nihonbashi, Japan

[21] Appl. No.: 210,986

[22] Filed: Mar. 18, 1994

[51] Int. Cl.[6] ..... G03C 7/407

[52] U.S. Cl. ..... 430/444; 430/467; 430/486; 430/487

[58] Field of Search ..... 430/444, 467, 430/486, 487; 564/301, 506; 528/424

[56] References Cited

U.S. PATENT DOCUMENTS

| | | | |
|---|---|---|---|
| 3,364,262 | 1/1968 | Cyba | 564/506 |
| 5,017,644 | 5/1991 | Fuller et al. | 524/612 |

*Primary Examiner*—Hoa Van Le
*Attorney, Agent, or Firm*—Oldham & Oldham Co.

[57] ABSTRACT

Color development composition and process. The compositions of this invention contain a color developer containing poly(N-hydroxyl alkyleneimine) and/or a derivative thereof, which are represented by general formula (I) shown below:

$$\left(R-\underset{\underset{OH}{|}}{N}\right)_n$$

wherein: "R" in said formula (I) represents an alkylene group, which may be substituted by a hydroxyl group, a carboxyl group, a sulfo group or other similar groups and may contain carbonyl linkage, ether linkage, double bond or other similar bond or linkage, and may also have a cyclic structure;" and "$_n$" in said formula (I) represents an integer in the range from 10 to 10,000. These compositions are used for processing silver halide-type color sensitized material. These compositions maintain the usable life of a color developer, do not cause decrease of color density or deterioration of quality of photographs such as fogging, and have no odor or deleterious substance.

3 Claims, No Drawings

COLOR DEVELOPMENT COMPOSITION AND PROCESS

Color development composite and processing method of silver halide type color sensitized material using said composite.

BACKGROUND

The present invention relates to a color development composite to be used for processing silver halide type color sensitized material and a processing method using such a color development composite, more particularly, to a color development composite which augments color developer stability when used and does not cause negative effects to the surroundings where it is used, as well as to a processing method of silver halide type color sensitized material using such color development composite.

PRIOR ART

Processing of color sensitized material after exposure basically comprises a color development process, a silver dye bleach process, a silver halide fix process, a bleach-fix process for simultaneously performing bleaching and fixing, a washing process or a rinsing process, a stabilizing process, and a drying process. In addition to them, there are processes performed to ensure that the above principal processes are performed in a stable condition or to increase physical strength and/or stability of exposed sensitized material after the processing. Among various processing for silver halide type color sensitized material, examples of widely used methods include one for producing a color print from color negative film and another for directly producing a final image in the form of positive color film and a print. Processes of these methods are based on a combination of a black and white developing process and either one of a process for producing color negative film or a process for producing color print. As users of color print film wish to see the prints as soon as possible, there has arisen a need to speed up processing of exposed film.

Recent improvement of sensitized materials has made quick processing of silver halide type color sensitized material possible. Furthermore, it is now easy to process a large quantity of material in a very short period of time by using an automatic developing processor. As automatic processors have become compact in size and low in price, a great number of them are now in use.

Color developer used for processing silver halide type color sensitized material typically includes primary aromatic amine type developing agent, such as, for example, paraphenylenediamine. Sulfite and hydroxylamine are also used as preservative to prevent the color developing agent from oxidization due to contact with air or other deterioration. Also used are alkali metal and alkali hydroxide, such as carbonic acid and phosphoric acid, to serve as alkaline agent for maintaining color developer alkalinity, restrainer, and, if necessary, various additive agents.

In the recent years, chloric silver bromide emulsion containing a high proportion of silver chloride is used as a silver halide type color sensitized material for color paper so as to permit rapid processing. Chloric silver bromide containing a high proportion of silver chloride used as sensitized material, however, presents a problem in that color density of processed prints is reduced when utilizing hydroxylamine which has been used heretofore. In cases where only sulfite is used as preservative for this reason, stability of the color developer is maintained to a certain extent. Nevertheless, when the developer is continuously used for some length of time, it begins to produce fogging of prints, and the developer therefore becomes unusable. In order to overcome such problems, N,N-diethyl hydroxylamine is now generally used instead of hydroxylamine. Like hydroxylamine, however, N,N-diethyl hydroxylamine, too, reduces color density, though not as much as hydroxylamine does. In addition, N,N-diethyl hydroxylamine has a distinctive odor which is environmentally undesirable—particularly so in cases where processing is performed at what is generally called a "minilab", in other words, a corner of an ordinary store. Furthermore, although it is common practice to use hydroxylamine as preservative for color developer for color negative film, hydroxylamine is a deleterious substance and therefore undesirable compound to use.

Automatic developing processors are widely used to process a great number of photos in a short period of time, with various solutions necessary for processing sensitized material being supplied as replenisher. As this replenisher is supplied in regular specified quantities, with a certain length of time allowed to use up each supply, the condition of the replenisher changes as tame goes by. As such change results in change of quality of processed photos, it is important that the condition of replenisher is kept stable. Moreover, as a certain length of time passes to discharge solution used in an automatic developing processor, which is discharged in such a manner that the discharged quantity is always in proportion to the supplied quantity, stability of the solution during that period is also required.

A photo-processing technician consigned to process photos has to perform the work quickly to satisfy the demands of his customers in a short period of time and, for this reason, requires processing agents that work rapidly. In order to perform speedy color development, color developer has to be a highly active agent. A highly active solution naturally deteriorates easily, and its composition tends to change after use for a long period of time, bringing about such unsatisfactory results as reduced developing activity, deterioration of quality of photo image and overall stain on the paper. These problems are apt to cause deterioration of color developing agent or preservative, decreased alkalinity of the solutions and/or accumulation of seepage substances from sensitized material which are processed. Furthermore, in cases where photos are processed by using an automatic developing processor, waste solution is produced in a quantity in proportion to the processed quantity of sensitized material processed is. In view of saving natural resources and reducing environmental pollutants, effort is made to cut down replenishment so as to reduce the amount of waste. When replenishment is reduced, however, it takes more time to use up a prepared quantity of replenisher, as well as the retention period of the solution in the processor, and the processing solution deteriorates in accordance with the lengthened time period.

Therefore, upon studying color developing composition for processing silver halide type color sensitized material and processing method using said composition which has such features as maintaining the usable life of color developer, free from the danger of decrease of color density as well as fogging of finished prints, minimal odor and being free of deleterious substance, inventors of the present invention has discovered that the problems described above could be overcome by using color developer containing a certain compound, thereby achieving the present invention.

Accordingly, it is an object of the present invention to provide a color developing composition which maintains the usable life of color developer, does not cause decrease of color density or deterioration of quality of photographs such as fogging, and has no odor or a deleterious substance, and also to provide a method of processing silver halide type color sensitized material by using said composition.

DISCLOSURE OF THE INVENTION

The objects of the present invention are attained by a color developing composition which maintains the usable life of color developer, does not cause decrease of color density or deterioration of quality of photographs such as fogging, and has no odor or a deleterious substance, and a method using said composition for processing silver halide type color sensitized material wherein color developer containing poly(N-hydroxyl alkyleneimine) and/or its derivative, which are represented by general formula (I) shown below.

General formula (I)

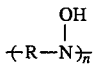

"R" in the above formula represents an alkylene group. The alkylene group may be substituted with a hydroxyl group, a carboxyl group, a sulfo group or other similar groups and may contain carbonyl linkage, ether linkage, double bond or other similar bond or linkage. Alkylene group may also have a cyclic structure. "n" in the said formula represents an integer in the range from 10 to 10,000.

Numerous kinds of silver halide type color sensitized materials are commercially available market nowadays. They are divided in accordance to their uses to color negative films, color reversal films, and those for color prints which include negative-positive printing materials and positive-positive printing materials. Most widely used among them are color negative films and negative-positive printing materials. There are a great many kinds of silver halide type color sensitized materials such as those, each having a different layer configuration and different characteristics. Configuration of silver halide constituting layers of a material also greatly varies in such characteristics as quantity of silver chloride, silver bromide and/or silver iodide contained, proportion of the compositions, as well as sizes and shapes of particles of silver halide. Furthermore, a large variety of additives, including sensitizing dyes, stabilizers, intensification agents and restrainers are used. The aforementioned particle sizes are described in various documents including the part from p.277 to p.278 of *The Basics of Photographic Industry: Silver Chloride Photos* (ed. by Japan Photograph Academy, published by Corona Publishing Co.). There are also a very large variety of substances used to synthesize various couplers for silver halide type color sensitized materials. The present invention is applicable to various silver halide type color sensitized materials having different configurations and/or compositions.

Silver halide type color sensitized materials are usually processed by means of automatic developing processors, of which there are many types having respective characteristics and varying in many aspects, such as processing methods, processing speed, processing temperature, processing steps, methods of supplying replenisher, handling methods of solution overflow, and so on. The present invention is applicable to these various automatic developing processors.

Examples of compounds used in the present invention are listed below. The present invention, however, is not limited to use of the following examples. Examples of poly(N-hydroxyl alkyleneimine) and derivatives include:

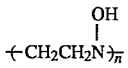
I-1

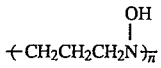
I-2

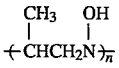
I-3

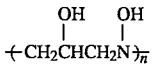
I-4

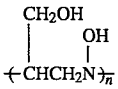
I-5

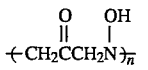
I-6

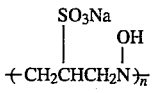
I-7

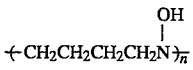
I-8

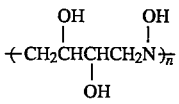
I-9

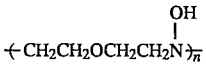
I-10

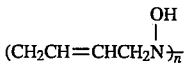
I-11

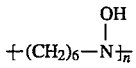
I-12

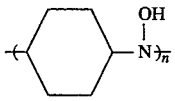
I-13

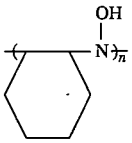
I-14

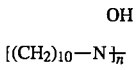
I-15

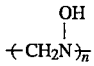
I-16

Color developer used for the present invention may utilize any of the generally used primary aromatic amine type color developing agents. Preferred examples of color developing agents to be used for the present invention are referred to in such documents as, for example, p.3100 of *Journal of American Chemical Society No.* 73 (1951) and the part from p.545 of *Modern Photographic Processing* by Haist (published in 1979 by John Wiley and Sons, New York).

Without departing from the scope or the spirit of the invention as defined in the appended claims, color developer for the present invention may contain various ingredients which are normally contained in color developer, such as, for example, various alkaline agents such as potassium hydroxide, sodium hydroxide, potassium carbonate, sodium carbonate, potassium phosphate and sodium phosphate, various sulfites, hydrogensulfites and metahydrogensulfites including sodium sulfite, potassium sulfite, sodium hydrogensulfite, potassium hydrogensulfite, metasodium hydrogensulfite and metapotassium hydrogensulfite, various halogenides including potassium chloride, sodium chloride, potassium bromide, sodium bromide, potassium iodide and sodium iodide, water softener such as amino polycarboxylic acid, polystyrene sulfonic acid and polyphosphonic acid, thickening agent such as ethylene glycol, diethylene glycol, diethanolamine and triethanolamine, and various development accelerators. Furthermore, various additives made of such compounds as, for example, nitrobenzimidazole, mercaptobenzimidazole, 5-methyl benzotriazole and/or 1-phenyl- 5-mercaptotetrazole, anti-stain and anti-sludge may also be used.

Preferable condition to utilize color developer according to the present invention is pH 9.5 and upward. In general cases, rapid processing is possible when pH is relatively high, but the quality of developer changes with the lapse of time, which may result in fogging or stain on the base of prints. By using color developing composition and/or the method according to the present invention, even with the elapse of time, the quality of color developer is preserved, without the danger of a decrease of color density, occurrence of fogging, unpleasant odor or deleterious effect caused by composition.

Bleaching agent used for bleaching solution for the present invention is metallic complex salt of organic acid, which is a complex of such organic acid as aminopolycarboxylic acid and citric acid, and metal, such as iron, cobalt and copper. One of the most preferable organic acid to produce metallic complex salt for this purpose is polycarboxylic acid. Polycarboxylic acid or aminopolycarboxylic acid for this purpose may be in the form of alkali metal salt, ammonium salt or water soluble amino salt. Examples of these compounds include ethylene diamine tetraacetic acid, diethylene-triamine pentaacetic acid, ethylenediamine-N-(β-oxyethyl)-N,N',N'-triacetic acid, propyne-diamine-tetraacetic acid, nitrilotriacetic acid, imino-diacetic acid, cyclohexane-diamine-tetraacetic acid, dihydroxy ethyl glycine citric acid, ethyl ether diamine-tetraacetic acid, ethylenediamine-tetrapropionic acid and phenylene-diamine-tetraacetic acid, and alkali metal salt, ammonium salt and water soluble amino salt of the above acids are also applicable. A hydroacid halide and a halogenous alkali metal salt or halogenous ammonium salt are normally used as the halogenating agent, hydroacid halide, h. Examples of such hydroacid halide and halogenous salt include hydrochloric acid, hydrobromic acid, sodium chloride, potassium chloride, ammonium chloride, sodium bromide, potassium bromide and ammonium bromide. A combination of inorganic weak acid, organic acid and alkaline agent is used as a buffer. Inorganic weak acids used for this purpose are carbonic acid, boric acid and phosphoric acid, such as, for example, sodium carbonate, potassium carbonate, ammonium carbonate, sodium borate, potassium borate, ammonium borate, sodium phosphate, potassium phosphate and ammonium phosphate, and examples of organic acids include such acetic acid, citric acid and succinic acid as sodium acetate, potassium acetate, ammonium acetate, sodium citrate, potassium citrate, ammonium citrate, sodium succinate, potassium succinate and ammonium succinate. In addition, other additives are used to accelerate a bleach process. The additives mentioned above are described in, for example, Japanese Patent Publication Laid-Open Nos.35727/1979, 25064/1980, 12549/1985, 76745/1985, 95540/1985, 125843/1985, 221754/1985, 230140/1985, 244950/1985, 50149/1986, 118752/1986, 80649/1987, 89963/1987, 131260/1987, 135835/1987, 166344/1987, 166345/1987, 166346/1987, 166347/1987, 166348/1987, 168159/1987, 8741/1988, 73247/1988, 163853/1988, 256953/1988, 261362/1988, 2048/1989, 13550/1989, 15739/1989, 102559/1989, 170943/1989, 211757/1989, 213650/1989, 22595/1989, 245256/1989, 44349/1990, 93454/1990, and 103041/1990.

Fixer in the fixing solution used for the present invention is such a compound as to become a water soluble complex salt through reaction with silver halide. Typically used for this purpose are thiosulfates and thiocyanates, such as sodium thiosulfate, potassium thiosulfate, ammonium thiosulfate, sodium thiocyanate, potassium thiocyanate and ammonium thiocyanate, as well as compounds of thiohamstoff and thioether. Sulfites, hydrogensulfites and metabisulfites, such as, for example, sodium sulfite, potassium sulfite, ammonium sulfite, sodium hydrogensulfite, potassium hydrogensulfite, ammonium hydrogensulfite, sodium metabisulfite and potassium metabisulfite are used as preservative. A combination of inorganic weak acid, organic acid and alkali agent is used as a buffer. Inorganic weak acids used for this purpose are carbonic acid, boric acid and phosphoric acid, such as, for example, sodium carbonate, potassium carbonate, ammonium carbonate, sodium borate, potassium borate, ammonium borate, sodium phosphate, potassium phosphate and ammonium phosphate, and examples of organic acids include such acetic acid, citric acid and succinic acid as sodium acetate, potassium acetate, ammonium acetate, sodium citrate, potassium citrate, ammonium citrate, sodium succinate, potassium succinate and ammonium succinate.

Bleaching agent and fixing agent used for the bleach-fix solution for the present invention are identical to the bleaching agent used for the bleach described above and the fixing agent used for the fixer described above. Buffer, too, is identical to that used for the aforementioned bleach and the fixer. The bleach-fix solution also uses additives to accelerate the bleach-fix process. Examples of additives for this purpose are described in, for example, Japanese Patent Publication Laid-Open No. 8506/1970, Japanese Patent Publication No. 8836/1970, Japanese Patent Publication Laid-Open No. 280/1971, Japanese Patent Publication No. 556/1971, Japanese Patent Publication Laid-Open No. 42349/1974, Japanese Patent Publication No. 9854/1978, Japanese Patent Publication Laid-Open No. 71634/1979 and Belgian Patent No. 770910.

According to the present invention, washing process is performed either by water washing or a stabilizing processing which substitutes for water washing. In cases where a stabilizing process is applied instead of water washing, stabilizer used for this purpose may contain chelating agent, buffer, pH regulator, antimold agent, hardening agent, optical whitening agent and other necessary agents. Preferred pH of stabilizer ranges from 2 to 9.

Examples and their synthesis methods of poly(N-hydroxyl alkyleneimine) and its derivatives used for the present invention have been disclosed in various documents, such as p.3144 of *Journal of the Chemical Society* (1963 ed.), p.796 of same (1955 ed.) , p. 964 of *Journal of the American Chemical Society No.* 79 (1957 ed.), p.255 of Ber.

No. 37 (1904 ed.), the specification of U.S. Pat. No. 3,287, 124, the specification of German Patent No. 1,159,634, Japanese Patent Publication Laid-Open No. 259145/1991. However, there has been no report made on a high molecular compound having a repetitious structure.

Examples and their synthesis methods of poly(alkyleneimine) have been disclosed in various documents, such as p. 271 of *Journal of polymer Science, Polymer Symposia No.* 56 (19763) , p. 108 of *Macromolecules No.* 5 (1972), p.958 of No. 7 of same (1974), p.435 of No. 11 of same (1978), p. 35 of *Polymer Journal No.* 3 (1972), p. 2609 of *Journal of the American Chemical Society No.* 82 (1960), and Japanese Patent Publication No. 18733/1988. However, there has been no report made on poly(alkyleneimine) in which the "N"th substituent is a hydroxyl group.

There are basically two methods of synthesizing poly(N-hydroxyl alkyleneimine) and the derivative used for the present invention, both of which are described hereunder.

[A] This method calls for directly oxidizing the nitrogen in poly(alkyleneimine) by means of hydrogen peroxide solution. For example, linear poly(N-hydroxyl alkyleneimine) (represented by (a) in the formula shown below) is obtained by using hydrogen peroxide solution to oxidize linear poly(alkyleneimine). Poly(alkyleneimine) mentioned above can be synthesized by, for example, the method described in p. 2609 of *Journal of the American Chemical Society No.* 82 (1960). In the same manner as (a), branched poly(N-hydroxyl alkyleneimine) (represented by (b) in the formula shown below) is obtained by oxidizing branched poly(alkyleneimine), which can be synthesized by, for example, the method described in p. 1301 of *Journal of Macromolecular Science Chemistry No. A4* (1970).

[B] This method calls for dehydrohalogenation between dihalide and hydroxylamine and is capable of producing poly(N-hydroxyl alkyleneimine) of various structures by means of selecting dihalide to be used. Through this method, it is possible to obtain branched poly(N-hydroxyl alkyleneimine) having an O-alkylation structure. This poly(N-hydroxyl alkyleneimine) is represented by (c) in the formula shown below.

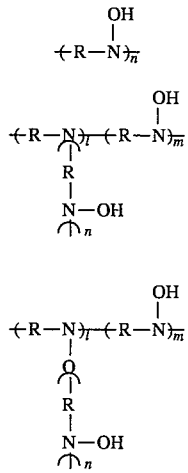

Quantity of hydroxylamine group in poly(N-hydroxyl alkyleneimine) synthesized as above can be measured by means of determining the quantity of 'H-NMR or volume of reduction of Fehling's solution by Bertrand's method or other suitable method. Furthermore, produced compound can be gelatinized by means of cross-linking with aldehyde compound, such as, for example, formaldehyde, glutaraldehyde and mucochloric acid, or nanoethylene glycol diglycyl ether.

Examples of methods of synthesizing poly(N-hydroxyl alkyleneimine) are as follows:

EXAMPLE 1

Dissolve 43 g of poly(ethyleneimine) (Epomine SP200: produced by Japan Catalyst Mfg.) in 800 ml of water. Drip 48 g of 35% hydrogen peroxide solution over a 15-minute period, while stirring the poly(ethyleneimine) solution at 60° C. Then, after maintaining it at 60° C. for one hour, apply vacuum concentration treatment. Thus, branched poly(N-hydroxyl ethyleneimine) is obtained.

EXAMPLE 2

Dissolve 60 g of hydroxylamine hydrochloride and 35 g of sodium hydroxide in 200 ml of water. Add 112g of 1.3-dichloro- 2-propanol, and drip over a one-hour period 70 g of sodium hydroxide dissolved in 100 ml of water into the aforementioned solution, which is being stirred at 60° C. in a nitrogen atmosphere. Then, after maintaining it at 60° C. for two hours, remove the water by means of vacuum distillation. Add 200 ml of ethanol anhydride to obtain a crystallized deposit. Separate the deposit by means of filtration and concentrate the deposit. Thus, branched poly(N, 2-dihydroxyl propyleneimine) is obtained.

EXAMPLE 3

Dissolve 43 g of poly(ethyleneimine) (a product of Eastman Fine Chemical) and 20 g of ethylene chlorohydrin in 400 ml of water. Drip over a 30-minute period 10 g of sodium hydroxide dissolved in 50 ml of water, while stirring the poly(ethyleneimine) solution at 60° C. and then maintain the solution at keep it at 60° C. for one hour. Then, drip over a 15-minute period 48 g of 35% hydrogen peroxide solution, with the temperature maintained at 60° C. After maintaining it at 60° C. for another hour, apply vacuum concentration treatment. Thus, branched poly(N-hydroxyl ethyleneimine) having its terminal group substituted by a hydroxyl group is obtained.

EXAMPLE 4

Dissolve 57 g of poly(trimethyleneimine), which has been synthesized with reference to p. 2609 of *Journal of the American Chemical Society No.* 82 (1960), in 500 ml of 50% aqueous solution of ethanol. Drip over a 15-minute period 97 g of 35% hydrogen peroxide solution thereinto, with the temperature maintained at 60° C. After maintaining it at 60° C. for one hour, apply vacuum concentration treatment. Thus, linear poly(N-hydroxyl triethyleneimine) is obtained.

Compound produced from reaction of another compound is normally separated from the reaction system of the original compound. This is because other compounds generated from the reaction in the system and the remainder of the original compound which were not used for the reaction prevent the desired compound from manifesting its proper characteristics, resulting in, other compounds having undesired effects on the target compound. Furthermore, in view of the usable life and stability of the compound, it is usually necessary to make the purity of the compound sufficiently high. For this reason, too, separation and purification processes are performed. As these processes require numerous kinds of materials, efficiency in relation to the materials is largely reduced. However, crude poly(N-hydroxyl alkylene-imine) synthesized according to the present invention does not contain any component which would affect photographic characteristics and, therefore, can be directly used as a component of color developer without purification. Thus, according to the present invention, it is possible to produce a compound with superior efficiency. Furthermore, as reacting condition is mild, thus obtained compound can be used as a component of color developer.

Preferred embodiments of the present invention are explained hereunder. It is to be understood, however, the scope and spirit of the present invention is not limited to the description of the embodiments and that various modifications may be made by those who are skilled in the art.

First Embodiment

Commercially available color papers which have been exposed were processed following the processing steps and using processing solutions shown in Table 1 below.

TABLE 1

| Processing steps | Temperature | Time period |
|---|---|---|
| color development | 35° C. | 45 sec. |
| bleach-fixing | 30–36° | 45 sec. |
| stabilizing | 30–36° | 90 sec. |
| drying | 70–85° | 60 sec. |

| | |
|---|---|
| (0052) | |
| Color Developer (A) | |
| diethylene triamine pentaacetic acid | 2.0 g |
| sodium chloride | 1.4 g |
| potassium carbonate anhydride | 25.0 g |
| N-ethyl-N-(β-methane sulfonamide ethyl)-3-methyl-4-aminoaniline sulfate | 5.0 g |
| sodium sulfite anhydride | 0.5 g |
| optical whitener (4,4'-diaminostilbene type) | 2.0 g |
| water: sufficient quantity to bring the total volume of the solution to: | 1.0 l |
| pH (using potassium hydroxide) | 10.05 |
| (0053) | |
| Color Developer Replenisher (A) (supply 160 ml per 1 $m^2$, of sensitized material) | |
| diethylene triamine pentaacetic acid | 2.0 g |
| potassium carbonate anhydride | 25.0 g |
| N-ethyl-N-(β-methane sulfonamide ethyl)-3-methyl-4-aminoaniline sulfate | 7.0 g |
| sodium sulfite anhydride | 0.7 g |
| optical whitener (4,4'-diaminostilbene type) | 2.3 g |
| diethyl hydroxylamine | 4.0 g |
| water: sufficient quantity to bring the total volume of the solution to: | 1.0 l |
| pH (using potassium hydroxide) | 10.45 |
| (0054) | |
| Color Developer Replenisher (B) (supply 80 ml per 1 $m^2$ of sensitized material) | |
| diethylene triamine pentaacetic acid | 2.0 g |
| potassium carbonate anhydride | 25.0 g |
| N-ethyl-N-(β-methane sulfonamide ethyl)-3-methyl-4-aminoaniline sulfate | 9.0 g |
| sodium sulfite anhydride | 0.7 g |
| optical whitener (4,4'-diaminostilbene type) | 2.5 g |
| diethyl hydroxylamine | 5.4 g |
| water: sufficient quantity to bring the total volume of the solution to: | 1.0 l |
| pH (using potassium hydroxide) | 10.65 |
| (0055) | |
| Color Developer (C) | |
| compound according to the present invention: | See Tables 2, 3 for quantity used |

TABLE 1-continued

| | |
|---|---|
| diethylene triamine pentaacetic acid | 2.0 g |
| sodium chloride | 1.4 g |
| potassium carbonate anhydride | 25.0 g |
| N-ethyl-N-(β-methane sulfonamide ethyl)-3-methyl-4-aminoaniline sulfate | 5.0 g |
| sodium sulfite anhydride | 0.5 g |
| optical whitener (4,4'-diaminostilbene type) | 2.0 g |
| water: sufficient quantity to bring the total volume of the solution to: | 1.0 l |
| pH (using potassium hydroxide) | 10.05 |
| (0056) | |
| Color Developer Replenisher (C) (supply 80 ml per 1 $m^2$ of sensitized material) | |
| compound according to the present invention: | See Tables 2, 3 for quantity used |
| diethylene triamine pentaacetic acid | 2.0 g |
| potassium carbonate anhydride | 25.0 g |
| sodium sulfite anhydride | 0.7 g |
| N-ethyl-N-(β-methane sulfonamide ethyl)-3-methyl-4-aminoaniline sulfate | 9.0 g |
| optical whitener (4,4'-diaminostilbene type) | 2.3 g |
| diethyl hydroxylamine | 4.0 g |
| water: sufficient quantity to bring the total volume of the solution to: | 1.0 l |
| pH (using potassium hydroxide) | 10.65 |
| (0057) | |
| Color Developer Replenisher (D) (supply 160 ml per 1 $m^2$ of sensitized material) | |
| compound according to the present invention: | See Tables 2, 3 for quantity used |
| diethylene triamine pentaacetic acid | 2.0 g |
| potassium carbonate anhydride | 25.0 g |
| sodium sulfite anhydride | 0.7 g |
| N-ethyl-N-(β-methane sulfonamide ethyl)-3-methyl-4-aminoaniline sulfate | 7.0 g |
| optical whitener (4,4'-diaminostilbene type) | 2.3 g |
| water: sufficient quantity to bring the total volume of the solution to: | 1.0 l |
| pH (using potassium hydroxide) | 10.45 |
| (0058) | |
| Bleach-fix Solution (as both basic solution and replenisher: supply 220 ml per 1 $m^2$ of sensitized material) | |
| ammonium thiosulfate | 70.0 g |
| sodium sulfite anhydride | 17.0 g |
| ethylenediamine iron(III) ammonium tetraacetate | 55.0 g |
| ethylendiamine disodium tetraacetate | 5.0 g |
| water: sufficient quantity to bring the total volume of the solution to: | 1.0 l |
| pH (using acetic acid) | 6.00 |
| (0059) | |
| Stabilizer (supply 250 ml per 1 $m^2$ of sensitized material) | |
| 2-aminobenzothiazole | 0.1 g |
| 1-hydroxy alkylidene-1,1-diphosphonic acid | 4.0 g |
| water: sufficient quantity to bring the total volume of the solution to: | 1.0 l |
| pH (using sodium hydroxide) | 7.00 |

For comparison tests, continuous processing was conducted by using an automatic developing processor during which time color developer replenisher (A) (160 ml per 1 $m^2$ of sensitized material) and color developer replenisher (B) (80 ml per 1 $m^2$ of sensitized material) were respectively supplied to samples of color developer (A).

Next, for tests to confirm the effect of the present invention, continuous processing was conducted, during which time color developer replenisher (C) (80 ml per 1 $m^2$ of sensitized material) and color developer replenisher (D) (160 ml per 1 $m^2$ of sensitized material) were respectively supplied to samples of color developer (C).

Tests were further divided to two groups in accordance to processing quantity: standard processing (processing quantity I) which calls for processing 15 $m^2$ of color paper per day for 10 days, a total of 150 $m^2$, and small quantity processing (processing quantity II) which calls for processing 5 $m^2$ of color paper per day for 30 days, a total of 150 $m^2$.

During the tests, the conditions at the time of the start and end of processing are observed by means of a commercially available control strip to measure the change in the minimum density (ΔDmin), sensitivity point (ΔLD) and the change in contrast (ΔHD-LD).

A reflection type densitometer (X-RITE310) was used for measurement, results of which are shown in Tables 2 and 3 below:

TABLE 2

| Test No. | Color Developing Replenisher | Processing Quantity | Additive Compound and its Quantity (g) | ΔD min | ΔLD | ΔHD-LD |
|---|---|---|---|---|---|---|
| 1 | A | I | — | 0 | −0.02 | −0.01 |
| Sample for | | | | 0.02 | −0.01 | 0 |
| Comparison | | | | 0.01 | −0.01 | 0 |
| 2 | B | I | — | 0.10 | −0.11 | −0.01 |
| Sample for | | | | 0.10 | −0.08 | −0.14 |
| Comparison | | | | 0.09 | −0.07 | −0.13 |
| 3 | C | I | Polyethyeleneimine | 0.24 | −0.10 | −0.18 |
| Sample for | | | 5.4 (2.7) | 0.17 | −0.11 | −0.20 |
| Comparison | | | | 0.18 | −0.10 | −0.18 |
| 4 | C | I | Poly(N-hydroxy | 0 | 0 | −0.01 |
| Present | | | ethyleneimine) | 0.01 | 0 | 0 |
| Invention | | | 5.4 (2.7) | 0 | 0.01 | 0 |

TABLE 3

| Test No. | Color Developing Replenisher | Processing Quantity | Additive Compound and its Quantity (g) | ΔD min | ΔLD | ΔHD-LD |
|---|---|---|---|---|---|---|
| 5 | B | I | Poly(N-hydroxy | 0 | −0.01 | 0 |
| Present | | | propyleneimine | 0 | 0 | −0.01 |
| Invention | | | 6.0 (3.0) | 0.01 | −0.01 | 0 |
| 6 | A | II | — | 0.13 | −0.15 | −0.09 |
| Sample for | | | | 0.16 | −0.14 | −0.11 |
| Comparison | | | | 0.16 | −0.12 | −0.16 |
| 7 | D | II | Poly(N-hydroxy | 0 | −0.01 | 0.01 |
| Present | | | ethyleneimine) | 0 | 0 | 0 |
| Invention | | | 4.0 (2.7) | 0 | 0.01 | −0.01 |
| 8 | D | II | Poly(N-hydroxy | 0.01 | 0 | −0.01 |
| Present | | | propyleneimine) | 0 | 0.01 | 0 |
| Invention | | | 4.0 (3.0) | 0 | 0 | 0 |

Figures in the upper, middle and lower rows of each category respectively represent color density of blue, green and red. The poly-(N-hydroxy alkyleneimine)s were respectively synthesized in the same manners as those described above, and the quantity of each compound is the quantity of substance excluding water. The values given in parentheses represent quantities in the basic solutions.

As it is apparent in the results shown above, no problem occurs during continuous processing of color paper, in cases where color developing replenisher is kept refilled in large quantities. (cf. Test No. 1)

On the other hand, in cases where quantities of replenisher are small, problems occur in various aspects, including an increase in the minimum density, decrease of sensitivity and deterioration of contrast. (cf. Test No. 2)

With the method using color developer according to the present invention, however, it is apparent that continuous processing is performed in a stable, troublefree condition, even when the quantity of replenisher is small. (cf. Test Nos. 4 and 5)

Although it is stated in the specification of Japanese Patent Publication No. 18733/1988 that poly(alkyleneimine) is effective as an antioxidant for color developer, it has been proved that poly(alkyleneimine), when directly added to color developer, is not capable of preventing oxidization of the color developer nor restraining changes in characteristics of the developer during continuous processing. (cf. Test No. 3)

Although no problem occurs when the processing quantity of sensitized material per day is large (Test No. 1), various problems, such as an increase in the minimum density, decrease of sensitivity and deterioration of contrast, occur when the processing quantity is mall. (Test No. 6)

With the method using color developer according to the present invention, however, it is apparent that no problem occurs during continuous processing, even when the per day processing quantity is small. (Test Nos. 7 and 8)

Consequently, when color photosensitized material of the silver halide type is processed by using color developer according to the present invention, processing is performed with the usable life of the color developer maintained, and the occurrence of color density decrease and fogging prevented. Furthermore, having minimal odor, color developer according to the present invention does not aggravate the surroundings where it being is used.

Second Embodiment

Commercially available color negative films which have been exposed were processed following the processing steps and using processing solutions shown in Table 4 below.

TABLE

| Processing steps | Temperature | Time Period |
|---|---|---|
| Color development | 38° C. | 3 min. 15 sec. |
| bleaching | 35–41° C. | 6 min. |
| fixing | 35–41° C. | 3 min. 15 sec. |
| washing (in running water) | 25–35° C. | 3 min. 15 sec. |
| stabilizing | 25–41° C. | 1 min. |
| drying | 40–70° C. | |

(0071)
Color Developer (E)

| | |
|---|---|
| potassium carbonate anhydride | 35.0 g |
| sodium sulfite anhydride | 4.0 g |
| potassium iodide | 0.002 g |
| sodium bromide | 1.3 g |
| hydroxylamine sulfate | 2.0 g |
| diethylene triamine pentaacetic acid | 2.0 g |
| 2-methyl-4-(N-ethyl-N-β-hydroxyethyl) aminoaniline sulfate | 4.5 g |
| water: sufficient quantity to bring the total volume of the solution to: | 1.0 l |
| pH (using potassium hydroxide) | 10.00 |

(0072)
Color Developer Replenisher (E)

| | |
|---|---|
| potassium carbonate anhydride | 35.0 g |
| sodium sulfite anhydride | 4.5 g |
| sodium bromide | 0.9 g |
| hydroxylamine sulfate | 3.0 g |
| diethylene triamine pentaacetic acid | 2.0 g |
| 2-methyl-4-(N-ethyl-N-β-hydroxyethyl) aminoaniline sulfate | 5.0 g |
| water: sufficient quantity to bring the total volume of the solution to: | 1.0 l |
| pH (using potassium hydroxide) | 10.00 |

(0073)
Color Developer (F)

| | |
|---|---|
| compound according to the present invention: | See Table 5 for quantity used |
| potassium carbonate anhydride | 35.0 g |
| sodium sulfite anhydride | 4.0 g |
| potassium iodide | 0.002 g |
| sodium bromide | 1.3 g |
| hydroxylamine sulfate | 2.0 g |
| diethylene triamine pentaacetic acid | 2.0 g |
| 2-methyl-4-(N-ethyl-N-β-hydroxyethyl) aminoaniline sulfate | 4.5 g |
| water: sufficient quantity to bring the total volume of the solution to: | 1.0 l |
| pH (using potassium hydroxide) | 10.00 |

(0074)
Color Developer Replenisher (F)

| | |
|---|---|
| compound according to the present invention: | See Table 5 for quantity used |
| potassium carbonate anhydride | 35.0 g |
| sodium sulfite anhydride | 4.5 g |
| sodium bromide | 0.9 g |
| hydroxylamine sulfate | 3.0 g |
| diethylene triamine pentaacetic acid | 2.0 g |
| 2-methyl-4-(N-ethyl-N-β-hydroxyethyl) aminoaniline sulfate | 5.0 g |
| water: sufficient quantity to bring the total volume of the solution to: | 1.0 l |
| pH (using potassium hydroxide) | 10.00 |

(0075)
Bleach (A)

| | |
|---|---|
| ethylenediamine iron (III) ammonium tetraacetate | 100.0 g |
| ammonium bromide | 150.0 g |
| glacial acetic acid | 13.0 g |
| water: sufficient quantity to bring the total volume of the solution to: | 1.0 l |
| pH (using aqueous ammonia) | 6.0 |

(0076)
Bleaching Replenisher (A)

| | |
|---|---|
| ethylenediamine iron (III) ammonium tetraacetate | 120.0 g |
| ammonium bromide | 170.0 g |
| glacial acetic acid | 15.0 g |
| water: sufficient quantity to bring the total volume of the solution to: | 1.0 l |
| pH (using aqueous ammonia) | 5.7 |

(0077)
Fixer (A)

| | |
|---|---|
| ammonium thiosulfate | 120.0 g |
| ethylendiamine disodium tetraacetate | 1.0 g |
| sodium hydrogen sulfite | 12.0 g |
| sodium hydroxide | 2.5 g |
| water: sufficient quantity to bring the total volume of the solution to: | 1.0 l |
| pH (using acetic acid) | 6.5 |

(0078)
Fixing Replenisher (A)

| | |
|---|---|
| ammonium thiosulfate | 140.0 g |
| ethylendiamine disodium tetraacetate | 1.5 g |
| sodium hydrogen sulfite | 15.0 g |
| sodium hydroxide | 3.0 g |
| water: sufficient quantity to bring the total volume of the solution to: | 1.0 l |
| pH (using acetic acid) | 6.5 |

(0079)
Stabilizer (A)

| | |
|---|---|
| Wettole? (a product of Chugai Photo Chemical Co.?) | 15.0 ml |
| formalin (37% solution) | 7.0 ml |
| water: sufficient quantity to bring the total volume of the solution to: | 1.0 l |

Used for processing were an automatic developing processor, color developer (A), bleach (A), fixer (A), stabilizer (A), and 36-exposure 35 mm film as sensitized material to be processed. As replenishing solutions, 50 ml of developing replenisher (A), 30 ml of bleaching replenisher (A), 50 ml of fixing replenisher (A) and 50 ml of stabilizer (A) were respectively supplied for each roll of said film.

Processing test was also conducted as to color developer (F) of the present invention, using the same processing solutions as above except that 50 ml of developing replenisher (F) was supplied for each roll of the said sensitized material.

10 rolls per day of the aforementioned color negative film were processed during 30 days, a total quantity of processed film amounting to 300 rolls. At that time, the conditions at the time of the start and end of processing were observed by means of a commercially available control strip to measure the change in the minimum density (ΔDmin), sensitivity point (ΔLD) and the change in contrast (ΔHD-LD).

A reflection type densitometer (X-RITE310) was used for measurement, results of which are shown in Table 5 below:

TABLE 5

| Test No. | Color Developing Replenisher | Additive Compound and its Quantity (g) | ΔD min | ΔLD | ΔHD-LD |
|---|---|---|---|---|---|
| 9 | E | — | 0 | 0 | −0.01 |
| Sample for | | | 0 | −0.01 | 0 |
| Comparison | | | 0.01 | 0 | −0.01 |
| 10 | F | Poly(N-hydroxy | 0 | −0.01 | 0 |
| Present | | ethyleneimine | 0 | 0 | 0 |
| Invention | | | 0 | −0.01 | 0.01 |
| 11 | F | Poly(N-hydroxy | 0 | 0 | 0.01 |
| Present | | propyleneimine) | 0.11 | 0 | 0 |
| Invention | | | 0 | −0.01 | 0 |

Figures on the upper, middle and lower rows of each category respectively represent color density of blue, green and red. The poly-(N-hydroxy alkyleneimine)s were respectively synthesized in the same manners as those described above, and the quantity of each compound is the quantity of substance excluding water. The values given in parentheses represent quantities in the basic solutions.

As it is apparent by the results shown above, the method using color developer according to the present invention is capable of continuously processing color negative film in a stable, troublefree condition. (cf. Test Nos. 10 and 11)

Consequently, when color photosensitized material of the silver halide type is processed by using color developer according to the present invention, processing is performed with the usable life of the color developer maintained, and occurrence of color density decrease and fogging prevented. Furthermore, containing no deleterious substance, color developer according to the present invention does not aggravate the surroundings where it is being used.

Third Embodiment

Color developing solutions having the following compositions for processing silver halide type color sensitized material were prepared, and then, after being stored for a week, densities of the color developing agents contained therein were compared.

| [Solution A] | |
|---|---|
| diethylene triamine pentaacetic acid | 1.0 g |
| sodium chloride | 2.5 g |
| optical whitener (4,4'-diaminostilbene type) | 5.0 g |
| sodium sulfite | 0.5 g |
| potassium carbonate | 25.0 g |
| N-ethyl-N-(β-methane sulfonamide ethyl)-3-methyl-4-aminoaniline sulfate (color developing agent) | 7.0 g |
| water: sufficient quantity to bring the total volume of the solution to: | 1.0 l |
| pH (using sodium hydroxide) | 10.4 |

Solution B 5.0 g of poly(N-hydroxyl ethyleneimine), which is represented by the aforementioned formula I-1, was added to the composition of Solution A above and prepared such that its total volume is 1000 ml and pH is 10.4.

Solution C 5.0 g of poly(N,2-dihydroxyl propyleneimine), which is represented by the aforementioned formula I-4, was added to the composition of Solution A above and prepared such that its total volume is 1000 ml and pH is 10.4.

The solutions were contained in respective 1 l beakers and stored uncovered for one week at room temperature. The density of color developing agent remained in each solution was analyzed by means of a high speed liquid chromatography. The result of the analysis is as follows:

| | Density of Remaining Color Developing Agent |
|---|---|
| Solution A | 4.8 g/l |
| Solution B | 6.8 g/l |
| Solution C | 6.8 g/l |

As it is apparent in the above result, poly(N-hydroxyl alkyleneimine) is effective compound to be used as an antioxidant of developing solution.

EFFECT OF THE INVENTION

As described above, when color development processing of silver halide type color sensitized material is continuously performed, the use of color developer containing poly(N-hydroxyl alkyleneimine) of the present invention or its derivative ensures stable processing as well as preservability of the color developer and restrains deterioration of the color developing agent caused by oxidization. Thus the present invention is capable of processing silver halide type color sensitized material in a condition such that there is no occurrence of color density decrease nor fogging. Furthermore, as the said composition according to the present invention has no odor nor a deleterious substance, it allows photo processing technicians to conduct processing in a good working surroundings.

What is claimed is:

1. A color-development composition used for color debelopment processing of exposed silver halide color sensitized material, said composition comprising an alkaline agent; a sulfite, hydrogensulfite, or a metahydrogen sulfite; an alkali metal halide, a color developing agent and water, and having a pH of at least 9.5, $$\left(\underset{\substack{|\\ OH}}{R}-N\right)_n \qquad (I)$$

R in said formula (I) represents an alkylene group, which may be substituted by a hydroxyl group, a carboxyl group, or a sulfo group and may contain carbonyl linkage, ehter linkage, or a double bond, and may also have a cyclic structure; and "n" in said formula (I) represents an integer in the range from 10 to 10,000.

2. A color development composition of claim 1 used for color development processing of exposed silver halide type color sensitized material, wherein said compound represented by general formula (I) is poly(N-hydroxyl ethyleneimine).

3. A color development composition of claim 1 used for color development processing of exposed silver halide type color sensitized material, wherein said compound represented by general formula (I) is poly(N-hydroxyl propyleneimine).

* * * * *